US006702559B1

(12) United States Patent
Norman

(10) Patent No.: US 6,702,559 B1
(45) Date of Patent: Mar. 9, 2004

(54) TEMPLATE FOR CREATING DESIGNS

(76) Inventor: Jimmy W. Norman, 846 E. 840 North, Orem, UT (US) 84097

( * ) Notice: Subject to any disclaimer, the term of this patent is extended or adjusted under 35 U.S.C. 154(b) by 389 days.

(21) Appl. No.: 08/989,342

(22) Filed: Dec. 12, 1997

(51) Int. Cl.[7] ..... B28B 17/00

(52) U.S. Cl. ..... 425/65; 425/458; 425/811; 249/120; 249/126; 249/129

(58) Field of Search ..... 425/63, 64, 65, 425/458, 811; 249/119, 120, 126, 129; 427/259, 265, 266, 282

(56) References Cited

U.S. PATENT DOCUMENTS 3,712,825 A * 1/1973 Yocum ..... 425/811
3,929,068 A * 12/1975 Budden ..... 101/128.21
4,129,669 A * 12/1978 Lopez
4,510,729 A * 4/1985 Syring ..... 52/745.09
4,774,108 A * 9/1988 Cano
5,186,983 A * 2/1993 Brown
5,389,176 A * 2/1995 Nakanishi et al. ..... 427/259
5,440,858 A * 8/1995 Hinkes
5,487,526 A * 1/1996 Hupp ..... 425/458
5,494,372 A * 2/1996 Oliver et al. ..... 404/72
5,502,941 A * 4/1996 Zember et al. ..... 52/314

* cited by examiner

*Primary Examiner*—Robert Davis
*Assistant Examiner*—Joseph S Del Sole
(74) *Attorney, Agent, or Firm*—Fehr Law Firm; Thompson E. Fehr

(57) ABSTRACT

A template for creating designs upon a surface. The template has apertures that are so positioned and shaped as to create the desired design upon the surface after such apertures have been filled with mud and the template has been removed. The template is a substantially planar structure which has a thickness equal to the desired depth for the desired three-dimensional design and adequate length and width to accommodate the length and width of the desired design and which is substantially impervious to the mud. Optionally, the template the template is permanently shaped so that when the template has been placed in position for the creation of the design, no gap will exist between the template and the surface upon which the design is to be placed. One or more edges of the template may be shaped to accommodate the shape of a structure which is on or rises from the surface on which the design is to be applied and which is adjacent to the location where the design is to be placed. And the template may have one or more accommodating apertures which are intended to accommodate an object on or rising from the surface and around which the design is desired to be placed.

20 Claims, 2 Drawing Sheets

TEMPLATE FOR CREATING DESIGNS

BACKGROUND OF THE INVENTION

1. Field of the Invention

This invention relates to a template and method for using the template to create designs on walls and ceilings, especially upon dry wall, plaster, and stucco.

2. Description of the Related Art

Templates are commonly used either to follow the edges of an aperture within the template with a pen or pencil to create an outline of an object. They are also generally used to block a portion of the paint from a spray gun to create symbols or letters, such as simple warnings on highways. The images created with such templates are, however, only two dimensional.

Templates associated with painting are the subjects of U.S. Pat. Nos. 4,129,669; 4,774,108; and 5,186,983.

Similarly, U.S. Pat. No. 5,440,858 the template possesses apertures in the desired shape and positions for the lines of a game court. Although the marking device of this patent is a clay-based material, the purpose for the patent, i.e., making the lines for a game court, clearly indicates that a substantially two-dimensional marking is created.

Three other patents are used to create a three-dimensional surface simulating either brickwork or stonework.

U.S. Pat. No. 5,494,372 applies to a grid having elongated member attached to connecting members to be applied, according to lines 46 through 47 of column 3 in that patent, "where a brick-like or stone-like pattern is desired." The grid is placed on a surface, a liquid spread over the surface in the open areas of the grid, the liquid is allowed to dry, and the grid is removed.

The template claimed in U.S. Pat. No. 4,510,729 of Ewald Syring is, however, intended to have mineral plaster sprayed onto it when it has been releasably attached to a wall. The apertures in the template are designed to create the appearance of bricks once the template has been removed from the wall. No other design is discussed for the apertures. In fact, the claims clarify that the solid portion of the template (termed "lands") correspond to the "structure of the joints."

Similarly, U.S. Pat. No. 5,502,941 claims a "flexible template panel having a pattern of desired grout lines . . . ."

None of the patents dealing with the creation of three-dimensional patterns suggests that the pattern would be anything other than that of brickwork or stonework.

Moreover, although U.S. Pat. No. 5,502,941 indicates that the template would be flexible and at least one embodiment of U.S. Pat. No. 4,510,729 would appear to be flexible since it is termed, on line 39 of column 3, a "paper-thin layer [that] can be rolled up," none of these patents indicate that the template is permanently shaped to accommodate a surface that is not flat.

Additionally, none of these templates is stated to be designed to accommodate any structure that rises from the surface which is to be coated.

The method claimed in U.S. Pat. No. 5,502,941 applies mortar to a substrate to create a first layer. Then the template is secured to the first layer. Mortar to create the pattern is then applied over the template and the first layer. Both layers do not contain a resultant design.

SUMMARY OF THE INVENTION

The template of the present invention contains apertures to create any desired decorative design, not merely to simulate brickwork or stonework.

The template is also permanently shaped to accommodate the surface to which a design is to be applied, whether that surface is flat or curved.

Edges of the template are shaped to accommodate the shape of any structure, such as a light fixture, which is on or rises from the surface on which the design is to be applied.

Alternatively or additionally, apertures exist in the template to accommodate structures which are on or rise from the surface on which the design is to be applied. And, rather than having such accommodating apertures already in the template, the template may be scored to create a section that can be pushed from the template to create an accommodating aperture.

Finally, to create designs upon designs, a first template may have apertures to create a first layer of a three-dimensional design. A second template then has apertures to create a design to be place on the first layer. Subsequent templates have apertures to create designs on the immediately preceding layer. Templates after the first template optionally have supports which extend from the template to the surface upon which the original three-dimensional layer is placed. And such subsequent templates are preferably either transparent or have alignment marks that can be coordinated with marks removably place on the surface to assure that the various layers of designs are properly oriented with respect to one another.

DESCRIPTION OF THE PREFERRED EMBODIMENT

A template 1 is placed adjacent to the surface on which the design is to be superimposed. Then mud, which can be any of the materials discussed in the prior-art patents but, preferably, any material known in the art of installing dry walls and stucco for repairing dry wall and stucco, is placed upon the template 1 so that the mud at least fills all the apertures 2, which are positioned and shaped to create the desired design, in the template 1. Excess mud is then scraped from the template 1 so that the mud is only in the apertures 2 and is level with the side of the template 1 that is facing away from the surface on which the design is to be placed. (The scraping can be done by any tool having a straight edge, preferably a trowel.) Finally, the template 1 is removed, leaving the mud on the surface in the locations where the apertures 2 existed in the template 1 and thereby creating the desired three-dimensional design on such surface.

Figure 1:
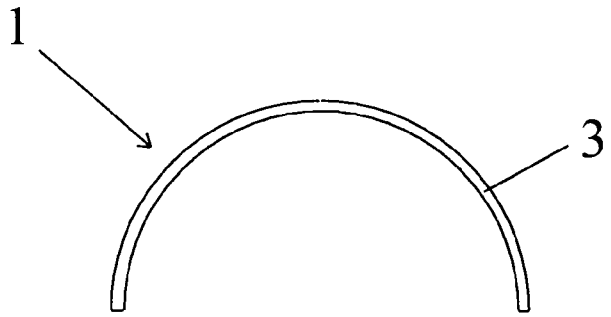
FIG. 1 depicts, as viewed from its edge, a template which is curved so that it can be used to apply a design to a curved surface, such as a pillar.

As illustrated in FIG. 1, the template 1 is permanently shaped to accommodate the surface to which a design is to be applied, i.e., the template 1 is permanently shaped so that when the template 1 has been placed in position for the creation of the design, no gap will exist between the template 1 and the surface upon which the design is to be placed.

Figure 3:
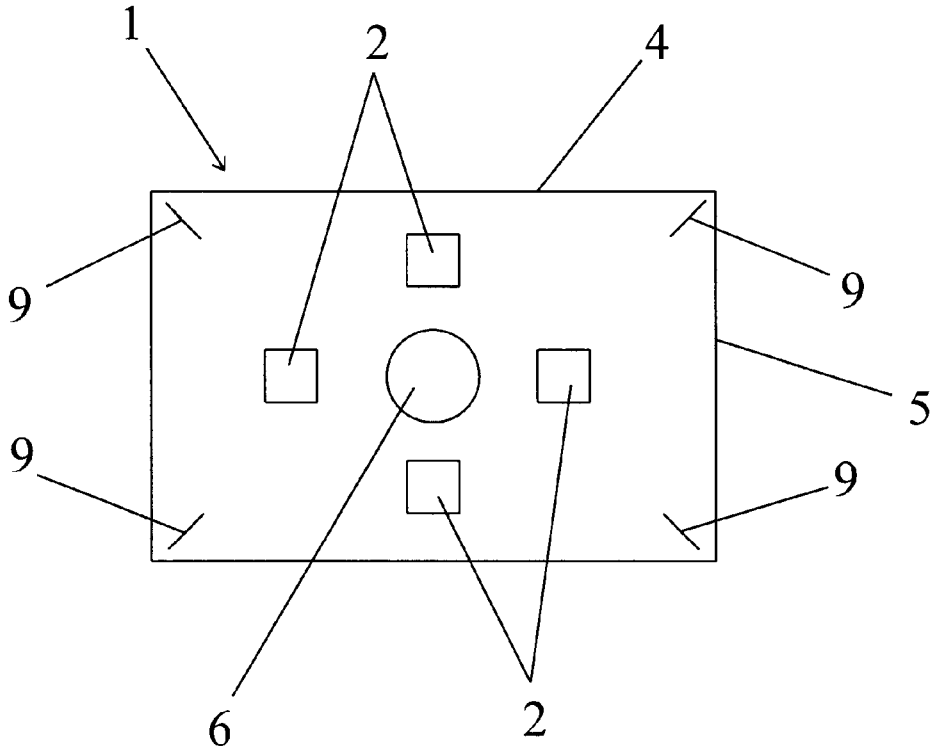
FIG. 3 illustrates a template possessing an aperture to accommodate a structure which is on or rises from the surface on which the design is to be applied.
Figure 4:
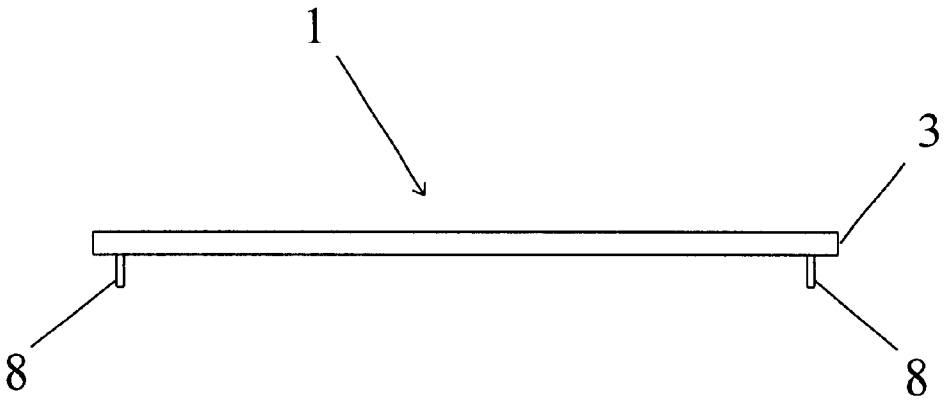
FIG. 4 shows, as viewed form its edge, a template have supports which extend from the template to the surface upon which the original three-dimensional layer is placed and alignment marks that can be coordinated with marks removably place on the surface to assure that the various layers of designs are properly oriented with respect to one another.

The template 1, neglecting the shaping to accommodate a surface, is a substantially planar structure which has a thickness 3 equal to the desired depth for one layer of the desired three-dimensional design and adequate length 4 and width 5 to accommodate the length and width of the desired design. (By placing the template 1 adjacent to a design that has been created with the template, larger designs which repeat the initial design may be created with the template 1.) The template 1 is substantially impervious to the mud from which the design is to be created. Besides having one or more apertures 2 in the template 1 that are intended to be filled with mud to create the desired design, there are optionally in the template 1, as depicted in FIG. 3, one or more apertures, designated accommodating apertures 6, which are intended to accommodate an object—such as a light fixture—on or rising from the surface and around which the design is desired to be placed. Also optionally in such a case, rather than having such accommodating apertures 6 already in the template 1, the template 1 may be scored to create a section that can be pushed from the template to create an accommodating aperture 6.

Figure 2:
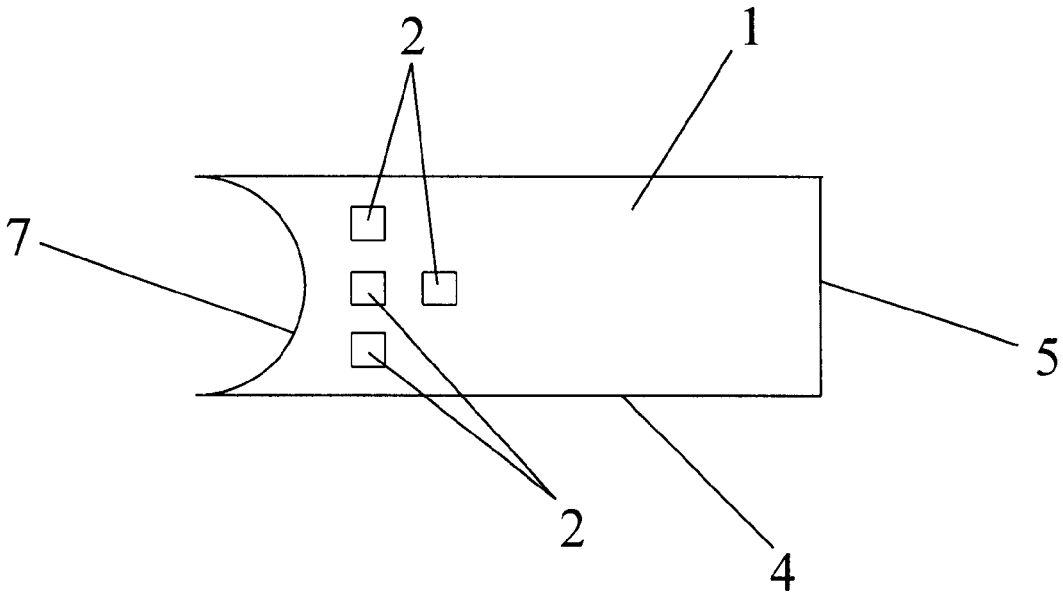
FIG. 2 portrays a template having an edge curved to accommodate a curved structure rising from the surface on which the design is to be placed.

Similarly, one or more edges 7 of the template 1 are preferably shaped, as portrayed in FIG. 2, to accommodate the shape of any structure, such as a light fixture, which is on or rises from the surface on which the design is to be applied and which is adjacent to the location where the design is to be placed.

Furthermore, as discussed above, to create designs upon designs, a first template 1 may have apertures 2 to create a first layer of a three-dimensional design. A second template 1 then has apertures 2 to create a design to be placed on the first layer. Subsequent templates 1 have apertures 2 to create designs on the immediately preceding layer. Templates 1 after the first template 1 optionally have supports 8 which are of sufficient length to extend from the template 1, past any previously applied layer of the design, to the surface upon which the original three-dimensional layer is placed and which supports 8 are so located on the template 1 that such supports will bypass any previously applied layer. And such subsequent templates 1 are preferably either transparent or have alignment marks 9 that can be coordinated with marks removably placed on the surface to assure that the various layers of designs are properly oriented with respect to one another.

A subsequent template 1 is placed upon the previously applied layer after such previously applied layer has dried. The process for creating the design upon the previously applied layer is then identical to the process by which the previously applied layer was created.

Fibre board, especially wooden fibre board sold under the trademarked name MASONITE, and solid resin such as that sold under the trademarked name PLEXIGLAS work well as materials from which to construct the template 1.

And, optionally, paint—or other pigment known in the art to be suitable—is mixed into the mud to create a colored design. If desired, different layers of designs can then have different colors.

I claim:

1. A template for creating, with mud, a three-dimensional design, other than a design simulating brickwork or stonework, upon a surface, which comprises:

a substantially planar structure which has a thickness equal to a desired depth for one layer of the desired three-dimensional design, such design being other than a design simulating brickwork or stonework, and adequate length and width to accommodate the length and width of the desired design, which is substantially impervious to the mud, and which has one or more apertures that are intended to be filled with mud to create the desired design on the surface; and supports which are of sufficient length to extend from said substantially planar structure, past any previously applied layer of the design, to the surface upon which the original three-dimensional layer is placed and which are so located on the substantially planar structure that said supports will bypass and previously applied layer.

2. The template for creating, with mud, a three-dimensional design upon a surface as recited in claim 1, wherein:

the template has one or more accommodating apertures which are intended to accommodate an object on or rising from the surface and around which the design is desired to be placed.

3. The template for creating, with mud, a three-dimensional design upon a surface as recited in claim 2, wherein:

one or more edges of the template are shaped to accommodate the shape of a structure which is on or rises from the surface on which the design is to be applied and which is adjacent to the location where the design is to be placed.

4. The template for creating, with mud, a three-dimensional design upon a surface as recited in claim 3, wherein:

the template is permanently shaped so that when the template has been placed in position for the creation of the design, no gap will exist between the template and a surface of a previously applied layer upon which a next layer of the design is to be placed.

5. The template for creating, with mud, a three-dimensional design upon a surface as recited in claim 1, wherein:

the template is scored to create a section that can be pushed from the template to create an accommodating aperture.

6. The template for creating, with mud, a three-dimensional design upon a surface as recited in claim 5, wherein:

one or more edges of the template are shaped to accommodate the shape of a structure which is on or rises from the surface on which the design is to be applied and which is adjacent to the location where the design is to be placed.

7. The template for creating, with mud, a three-dimensional design upon a surface as recited in claim 6, wherein:

the template is permanently shaped so that when the template has been placed in position for the creation of the design, no gap will exist between the template and a surface of a previously applied layer upon which a next layer of the design is to be placed.

8. The template for creating, with mud, a three-dimensional design upon a surface as recited in claim 1, wherein:

one or more edges of the template are shaped to accommodate the shape of a structure which is on or rises from the surface on which the design is to be applied and which is adjacent to the location where the design is to be placed.

9. The template for creating, with mud, a three-dimensional design upon a surface as recited in claim 8, wherein:

the template is permanently shaped so that when the template has been placed in position for the creation of the design, no gap will exist between the template and a surface of a previously applied layer upon which a next layer of the design is to be placed.

10. The template for creating, with mud, a three-dimensional design upon a surface as recited in claim 1, wherein:

the template is permanently shaped so that when the template has been placed in position for the creation of the design, no gap will exist between the template and a surface of a previously applied layer upon which a next layer of the design is to be placed.

11. The template for creating, with mud, a three-dimensional design upon a surface as recited in claim 10, wherein:

the template has one or more accommodating apertures which are intended to accommodate an object on or rising from the surface and around which the design is desired to be placed.

12. The template for creating, with mud, a three-dimensional design upon a surface as recited in claim 10, wherein:

the template is scored to create a section that can be pushed from the template to create an accommodating aperture.

13. A template for creating, with mud, a three-dimensional design, other than a design simulating brickwork or stonework, upon a surface, which comprises:

a substantially planar structure which has a thickness equal to a desired depth for one layer of the desired three-dimensional design, such design being other than a design simulating brickwork or stonework, and adequate length and width to accommodate the length and width of the desired design, which is substantially impervious to the mud, and which has one or more apertures that are intended to be filled with mud to create the desired design on the surface; wherein the template has one or more accommodating apertures which are intended to accommodate an object on or rising from the surface and around which the design is desired to be placed.

14. The template for creating, with mud, a three-dimensional design upon a surface as recited in claim 13, wherein:

one or more edges of the template are shaped to accommodate the shape of a structure which is on or rises from the surface on which the design is to be applied and which is adjacent to the location where the design is to be placed.

15. The template for creating, with mud, a three-dimensional design upon a surface as recited in claim 14, wherein:

the template is permanently shaped so that when the template has been placed in position for the creation of the design, no gap will exist between the template and the surface upon which the design is to be placed.

16. The template for creating, with mud, a three-dimensional design upon a surface as recited in claim 13, wherein:

the template is permanently shaped so that when the template has been placed in position for the creation of the design, no gap will exist between the template and the surface upon which the design is to be placed.

17. A template for creating, with mud, a three-dimensional design, other than a design simulating brickwork or stonework, upon a surface, which comprises:

a substantially planar structure which has a thickness equal to a desired depth for one layer of the desired three-dimensional design, such design being other than a design simulating brickwork or stonework, and adequate length and width to accommodate the length and width of the desired design, which is substantially impervious to the mud, and which has one or more apertures that are intended to be filled with mud to create the desired design on the surface; wherein the template is scored to create a section that can be pushed from the template to create an accommodating aperture.

18. The template for creating, with mud, a three-dimensional design upon a surface as recited in claim 17, wherein:

one or more edges of the template are shaped to accommodate the shape of a structure which is on or rises from the surface on which the design is to be applied and which is adjacent to the location where the design is to be placed.

19. The template for creating, with mud, a three-dimensional design upon a surface as recited in claim 18, wherein:

the template is permanently shaped so that when the template has been placed in position for the creation of the design, no gap will exist between the template and the surface upon which the design is to be placed.

20. The template for creating, with mud, a three-dimensional design upon a surface as recited in claim 17, wherein:

the template is permanently shaped so that when the template has been placed in position for the creation of the design, no gap will exist between the template and the surface upon which the design is to be placed.

* * * * *